US009297230B2

(12) United States Patent
Stair

(10) Patent No.: US 9,297,230 B2
(45) Date of Patent: Mar. 29, 2016

(54) TELESCOPING LATCHING MECHANISM FOR CASING CEMENTING PLUG

(71) Applicant: Halliburton Energy Services, Inc., Houston, TX (US)

(72) Inventor: Todd Anthony Stair, Norman, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 583 days.

(21) Appl. No.: 13/653,101

(22) Filed: Oct. 16, 2012

(65) Prior Publication Data

US 2014/0102723 A1 Apr. 17, 2014

(51) Int. Cl.

| | |
|---|---|
| ***E21B 33/14*** | (2006.01) |
| ***E21B 23/08*** | (2006.01) |
| ***E21B 33/16*** | (2006.01) |

(52) U.S. Cl.

CPC ..... *E21B 33/14* (2013.01); *E21B 23/08* (2013.01); *E21B 33/16* (2013.01)

(58) Field of Classification Search

CPC ..... E21B 33/16; E21B 33/146; E21B 33/12; E21B 33/1212; E21B 33/128; E21B 33/1285; E21B 33/13; E21B 33/14

See application file for complete search history.

(56) References Cited

U.S. PATENT DOCUMENTS

| | | | | |
|---|---|---|---|---|
| 4,671,358 | A * | 6/1987 | Lindsey et al. | 166/291 |
| 5,020,597 | A * | 6/1991 | Braddick et al. | 166/291 |
| 5,437,330 | A | 8/1995 | Gambertoglio | |
| 8,201,634 | B2 * | 6/2012 | Laurel et al. | 166/335 |
| 8,276,665 | B2 * | 10/2012 | Webb et al. | 166/285 |
| 2004/0020641 | A1 | 2/2004 | Budde | |
| 2008/0149336 | A1 | 6/2008 | Szarka et al. | |
| 2008/0251253 | A1 * | 10/2008 | Lumbye | 166/285 |
| 2009/0151960 | A1 | 6/2009 | Rogers et al. | |
| 2010/0096187 | A1 | 4/2010 | Storm, Jr. et al. | |
| 2012/0234561 | A1 * | 9/2012 | Hall et al. | 166/386 |

OTHER PUBLICATIONS

International Search Report and Written Opinion issued in PCT Application No. PCT/US2013/065248, mailed Jan. 17, 2014, 9 pages.

* cited by examiner

*Primary Examiner* — Nicole Coy
*Assistant Examiner* — Tara Schimpf
(74) *Attorney, Agent, or Firm* — John W. Wustenberg; Baker Botts L.L.P.

(57) ABSTRACT

Improved cementing plugs and methods of using these cementing plugs in subterranean wells are disclosed. A cementing plug comprises a hollow mandrel and one or more wiper elements coupled to the mandrel. A nose is coupled to the hollow mandrel and is movable between a retracted position and an extended position. A portion of the nose is positioned within the mandrel when in the retracted position. This portion of the nose is positioned outside the mandrel when in the extended position.

8 Claims, 9 Drawing Sheets

TELESCOPING LATCHING MECHANISM FOR CASING CEMENTING PLUG

BACKGROUND

The present disclosure generally relates to subterranean operations. More particularly, the present disclosure relates to improved cementing plugs and methods of using these cementing plugs in subterranean wells.

During the drilling and construction of subterranean wells, it may be desirable to introduce casing strings ("casing") into the wellbore. To stabilize the casing, a cement slurry is often pumped downwardly through the casing, and then upwardly into the annulus between the casing and the walls of the wellbore. Once the cement sets, it holds the casing in place, facilitating performance of subterranean operations.

Prior to the introduction of the cement slurry into the casing, the casing may contain a drilling fluid or other servicing fluids that may contaminate the cement slurry. To prevent this contamination, a cementing plug, often referred to as a "bottom" plug, may be placed into the casing ahead of the cement slurry as a boundary between the two. The plug may perform other functions as well, such as wiping fluid from the inner surface of the casing as it travels through the casing, which may further reduce the risk of contamination. After the bottom plug reaches the landing collar, a part of the plug body may rupture to allow the cement slurry to pass through.

Similarly, after the desired quantity of cement slurry is placed into the wellbore, a displacement fluid is commonly used to force the cement into the desired location. To prevent contamination of the cement slurry by the displacement fluid, a "top" cementing plug ("top plug") may be introduced at the interface between the cement slurry and the displacement fluid. This top plug also wipes cement slurry from the inner surfaces of the casing as the displacement fluid is pumped downwardly into the casing. Sometimes a third plug may be used, for example, to perform functions such as preliminarily calibrating the internal volume of the casing to determine the amount of displacement fluid required, or to separate a second fluid ahead of the cement slurry (e.g., where a preceding plug may separate a drilling mud from a cement spacer fluid, the third plug may be used to separate the cement spacer fluid from the cement slurry).

A float valve or float collar is commonly used above the landing collar to prevent the cement from flowing back into the inside of the casing. When the bottom plug arrives at the float valve, fluid flow through the float valve is stopped. Continued pumping results in a pressure increase in the fluids in the casing, which indicates that the leading edge of the cement composition has reached the float valve.

Operations personnel then increase the pump pressure to rupture a frangible device within the bottom plug. Said frangible device may be in the form of a pressure sensitive disc, rupturable elastomeric diaphragm, or detachable plug (stopper) portion which may or may not remain contained within the bottom plug. After the frangible device has failed, the cement composition flows through the bottom plug, float valve and into the annulus. When the top plug contacts the bottom plug which had previously contacted the float valve, fluid flow is again interrupted, and the resulting pressure increase indicates that all of the cement composition has passed through the float valve.

The cementing plug also wipes drilling fluid from the inner surface of the pipe string as it travels through the pipe string, thereby preventing contamination of the cement slurry by the drilling fluid as it is pumped downhole. Once placed in the annular space, the cement composition is permitted to set therein, thereby forming an annular sheath of hardened, substantially impermeable cement therein that substantially supports and positions the casing in the wellbore and bonds the exterior surface of the casing to the interior wall of the wellbore.

A cementing plug typically has a nose on its downhole end to help it land and engage into the landing collar at the bottom of the wellbore. Conventional cementing plugs travel downhole with a nose extended toward the bottom of the borehole. However, the extended nose causes the center of mass of the cementing plug to be offset. The cementing plug, therefore, is not balanced while traveling downhole. Additionally, the nose may get stuck to the sides of the casing or other protrusions or irregularities in its path. With the nose stuck, the cementing plug may not be able to travel downhole. As the pressure from the fluid above the cementing plug increases, the fluid may eventually bypass the cementing plug and cause undesirable contamination.

SUMMARY

The present disclosure generally relates to subterranean operations. More particularly, the present disclosure relates to improved cementing plugs and methods of using these cementing plugs in subterranean wells.

Improved cementing plugs and methods of using these cementing plugs in subterranean wells are disclosed. A cementing plug comprises a hollow mandrel and one or more wiper elements coupled to the mandrel. A nose is coupled to the hollow mandrel and is movable between a retracted position and an extended position. A portion of the nose is positioned within the mandrel when in the retracted position. This portion of the nose is positioned outside the mandrel when in the extended position.

The features and advantages of the present disclosure will be readily apparent to those skilled in the art upon a reading of the description of exemplary embodiments, which follows.

BRIEF DESCRIPTION OF THE DRAWINGS

These drawings illustrate certain aspects of some of the embodiments of the present invention, and should not be used to limit or define the invention.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples," as used herein are intended to mean either an indirect or a direct connection. Thus, if a first device couples to a second device, that connection may be through a direct connection, or through an indirect electrical or mechanical connection via other devices and connections. The term "upstream" as used herein means along a flow path towards the source of the flow, and the term "downstream" as used herein means along a flow path away from the source of the flow. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

The present disclosure generally relates to subterranean operations. More particularly, the present disclosure relates to improved cementing plugs and methods of using these cementing plugs in subterranean wells.

Figure 1A:
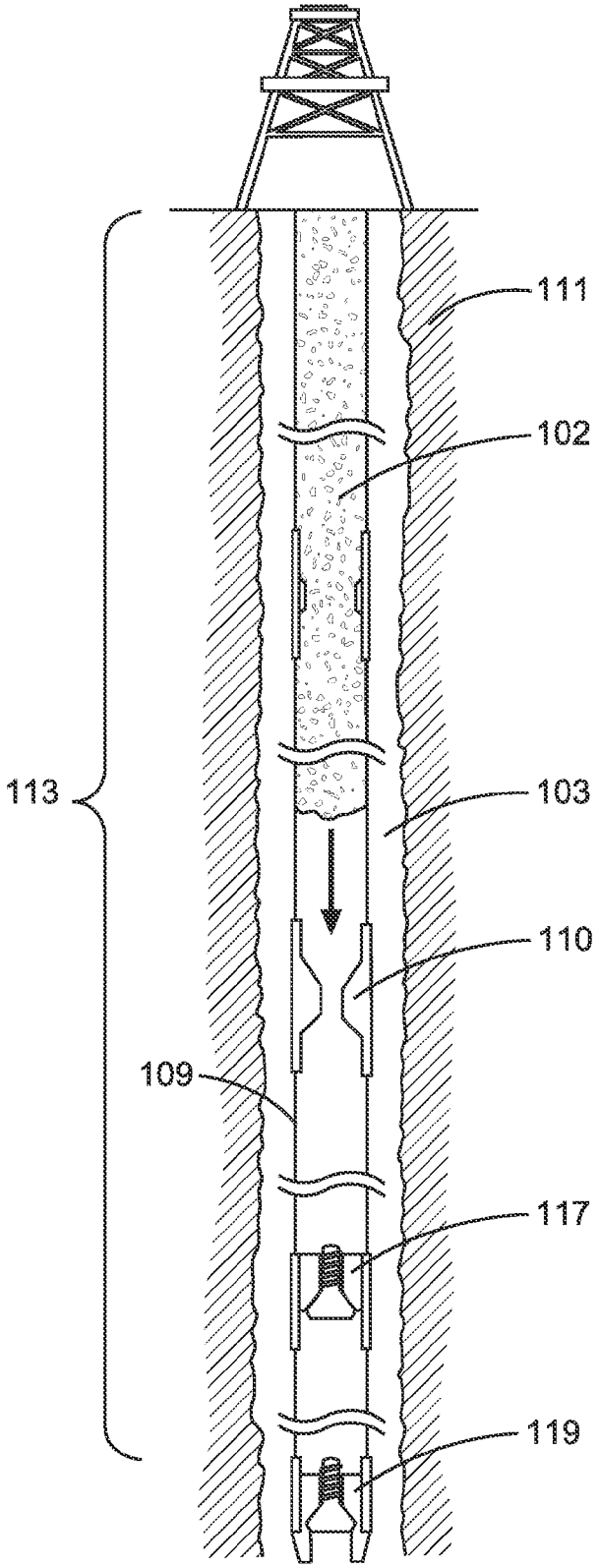
FIGS. 1A-1D show the process of sending a cementing plug downhole in accordance with an illustrative embodiment of the present disclosure.

FIGS. 1A-1D show the process of sending a cementing plug 100 downhole in accordance with an illustrative embodiment of the present disclosure. As shown in FIG. 1A, a wellbore 113 may be drilled in a subterranean formation 111 to be developed. In certain implementations, a casing 109 may be inserted into the wellbore 113 and an annulus 103 may be formed between the casing 109 and the wellbore 113. Once the casing 109 is inserted into the wellbore 113, cement 102 may be pumped downhole from the surface through the casing 109 into the wellbore 113. A landing collar 110, a float collar 117 and/or a float or guide shoe 119 may be positioned at desired axial locations within the wellbore 113 to regulate disposition of cement 102 into the wellbore 113 as described in more detail below.

Figure 1B:
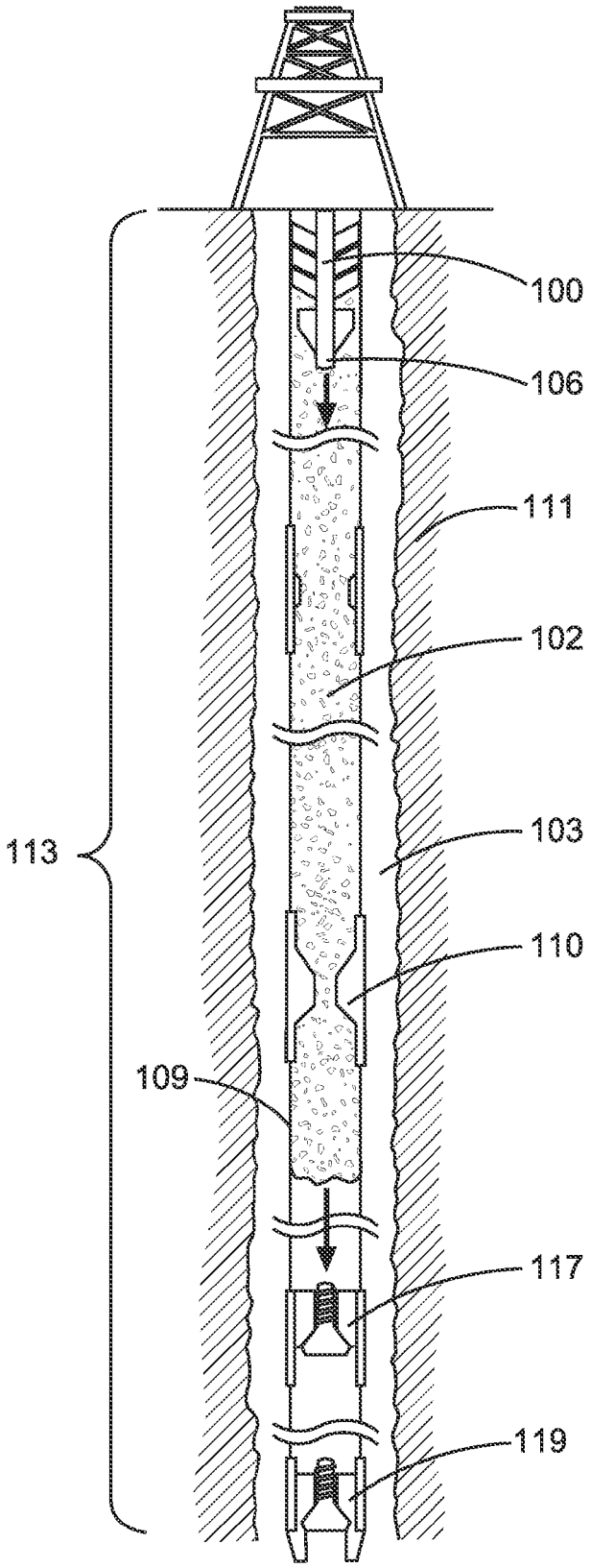
Figure 1C:
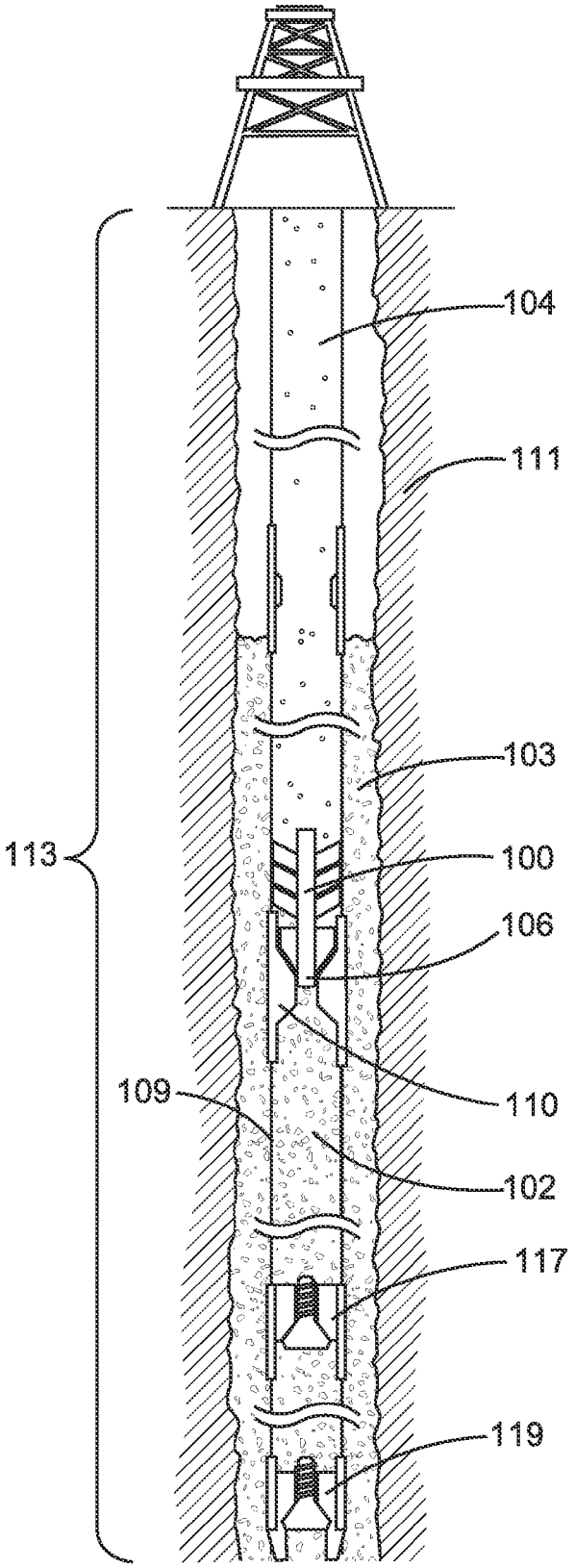
Figure 1D:
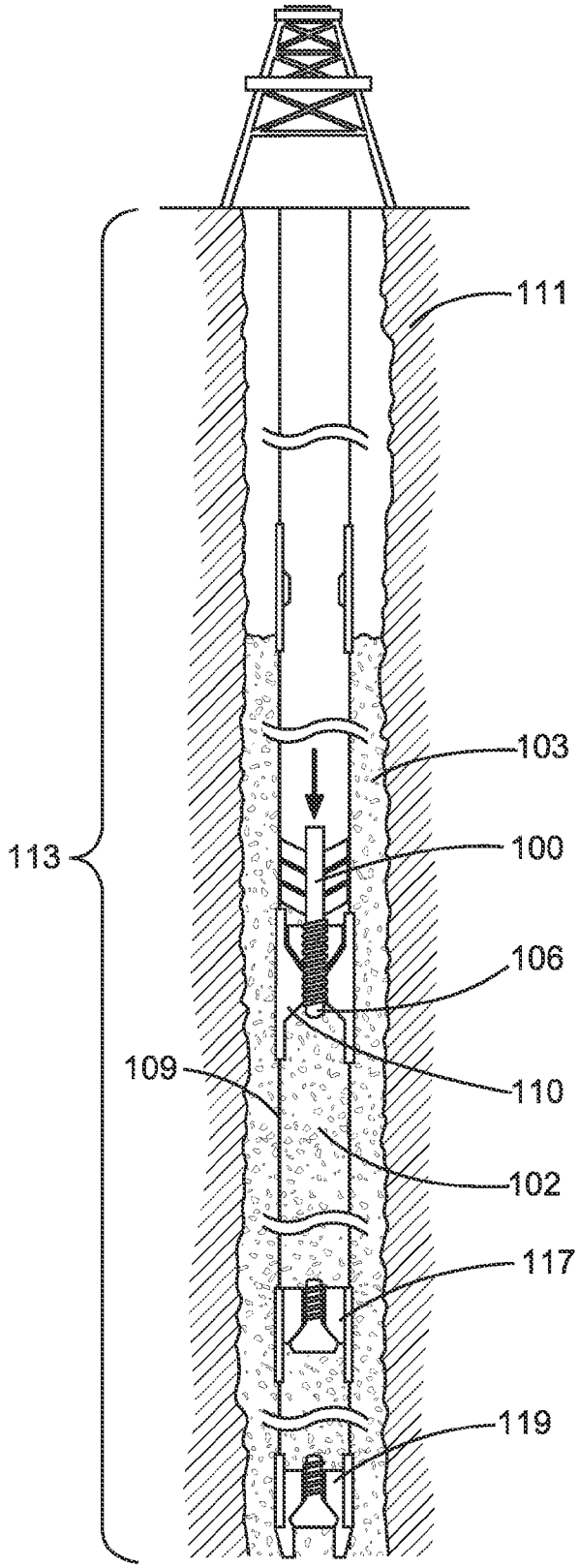

Turning now to FIG. 1B, a cementing plug 100 having a nose 106 may be inserted into the casing 109 after a predetermined amount of cement 102 is directed downhole. As shown in FIG. 1C, a displacement fluid 104 may be injected into the wellbore 113 through the casing 109 to help move the cementing plug 100 and the cement 102 downhole. The displacement fluid 104 and the cementing plug 100 push the cement 102 through the casing 109 and the landing collar 110, out of the guide shoe 119, and into the annulus 103. The cementing plug 100 continues to move downhole through the casing 109 until it lands on a landing collar 110 as shown in FIG. 1D. Then, pressure builds up behind the cementing plug 100 due to the displacement fluid 104 being pumped downhole. Shear pins located within the cementing plug 100 are sheared, allowing the nose 106 of the cementing plug 100 to be extended. This operation of the cementing plug 100 is discussed in more detail below in conjunction with FIGS. 2A and 2B. The pressure moves to the internal sealing geometry of the landing collar 110. This seal shuts off the well, allowing operations to continue without compromising the first stage cement. Once the cementing plug 100 has landed in and engaged the landing collar 110, the cementing plug 100 can no longer move downhole. An operator may be notified once the cementing plug 100 has landed by observing a pressure increase on the surface. In certain embodiments, one or more sensors may be coupled to the nose 106 and may notify an operator when the nose 106 is in its extended position. Once the operator is notified that the cementing plug 100 has landed and/or that the nose 106 is in its extended position, the operator may increase pressure to test the casing 109. The sealing capabilities of the cementing plug 100 allow for pressure to be applied prior to the cement 102 hardening. Utilizing a plug like this will enable the operator to control hydraulically operated tools in the casing 109 prior to allowing the cement 102 to harden. After the cement 102 hardens, the operator may drill the cementing plug 100 out of the wellbore 109 along with the cement remaining in the casing 109 below the cementing plug 100.

Figure 2A:
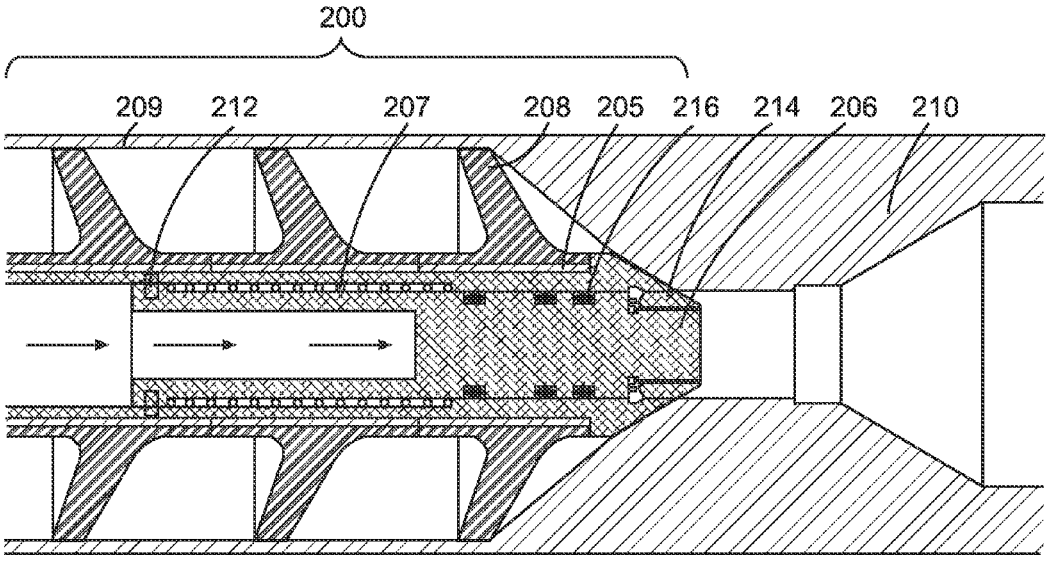
FIG. 2A is a cross-sectional view of a cementing plug with a retracted nose in accordance with one embodiment of the present invention.

Referring now to FIG. 2A, a cross-sectional view of a cementing plug in accordance with an embodiment of the present disclosure is denoted generally with reference numeral 200. In operation, the cementing plug 200 may be used in the same manner discussed in conjunction with FIG. 1. The cementing plug 200 includes a hollow mandrel 205 coupled to one or more springs 207. Springs 207 are shown in the embodiment of FIG. 2A for illustrative purposes. However, the present disclosure is not limited to using springs, and other methods of storing energy (e.g., a compressible fluid) may be used without departing from the scope of the present disclosure. The springs 207 may be coupled to the exterior of a nose 206. The nose 206 is positioned within the mandrel 205 as shown in FIG. 2A and is selectively extendable from the mandrel 205 as discussed in more detail below. A plurality of wiper blades 208 may be coupled to the exterior of the mandrel 205. The wiper blades 208 clean the tubing as the cementing plug 200 moves downhole. Additionally, the wiper blades 208 may apply pressure and direct fluids through the casing and may form a barrier between fluids positioned above and below them in the casing 209. The cementing plug 200 is directed through the casing 209 and moves along the casing 209 until it reaches a landing collar 210. The term "landing collar" as used herein may refer to a number of structures, such as, for example, a mating geometry, a landing adapter, or a landing geometry. FIG. 2A shows the cementing plug 200 initially landed on the landing collar 210 with the springs 207 in an extended position while the nose 206 is in a retracted position. The cementing plug 200 travels downhole with the springs 207 in an extended position storing the nose 206 inside the mandrel 205. Shear pins 212 hold the springs 207 in place while the cementing plug 200 travels downhole. Maintaining the nose 206 in its retracted position as the cementing plug 200 travels downhole provides several advantages. For instance, with the nose 206 in the retracted position, it is less likely for the cementing plug 200 to get stuck in the casing. Moreover, with the nose 206 in the retracted position, the cementing plug 200 is more stable as it moves downhole through the casing 209. When the cementing plug 200 initially lands in the landing collar 210, the nose 206 is located inside the mandrel 205.

Figure 2B:
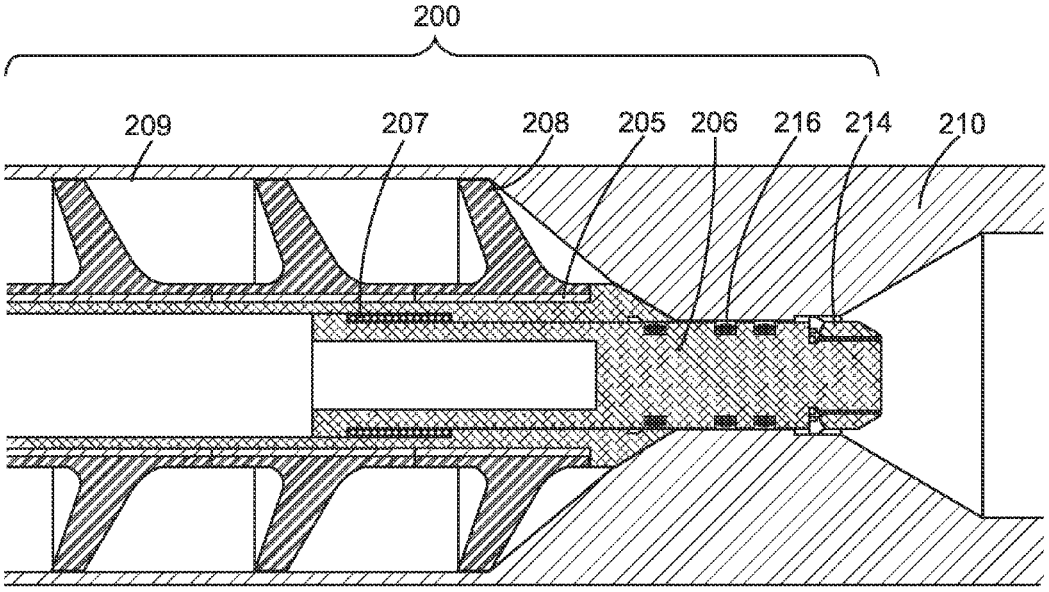
FIG. 2B is a cross-sectional view of the cementing plug of FIG. 2A, with its nose extended in accordance with an embodiment of the present invention.

FIG. 2B shows the cementing plug 200 after it has landed on the landing collar 210 with the nose 206 in the extended position. Specifically, the nose 206 is coupled to a latching mechanism of the landing collar 210 with the springs 207 in a contracted position while the nose 206 is in a extended position. As fluid builds up inside the hollow interior of the mandrel 205, pressure inside the mandrel 205 increases, pushing out the nose 206. Specifically, the shear pins 212, shown in FIG. 2A, which hold the springs 207 in place during the cementing plug's 200 journey downhole, are released, and the springs 207 contract. The nose 206 then is free to extend into the hollow portion of the landing collar 210. The tip of the nose 206 is designed so that as it enters the landing collar 210, a locking mechanism 214 holds the nose 206 in place in its extended position as shown in FIG. 2B. Moreover, one or more sealing components 216 may be placed on the nose 206. With the nose 206 in the extended position, the sealing components 216 provide a seal between the landing collar 210 and the nose 206. When in the extended position, at least a portion of the nose 206 that was previously positioned within the mandrel 205 will be extended outside the mandrel 205. For instance, in certain embodiments, the portion of the nose 206 that includes the locking mechanism 214 and/or the sealing components 216 may be positioned within the mandrel 205 in the retracted position and may extend outside the mandrel 205 in the extended position.

Figure 3:
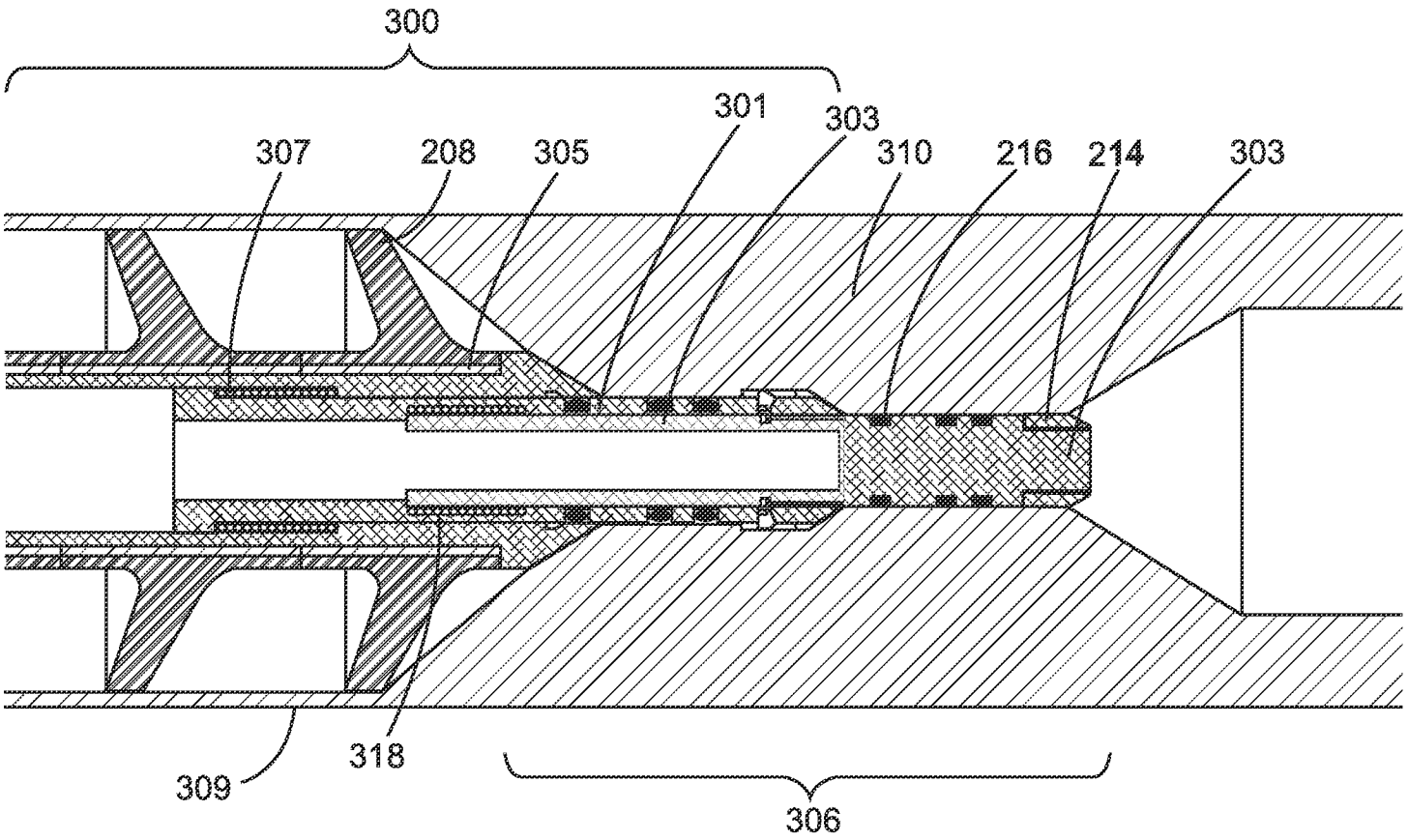
FIG. 3 is a cross-sectional view of a cementing plug in accordance with another embodiment of the present invention.

Referring now to FIG. 3, a cementing plug in accordance with another illustrative embodiment of the present disclosure is denoted generally with reference numeral 300. The cementing plug 300 comprises a first nose portion 301 and a second nose portion 303. The second nose portion 303 may have a smaller diameter than the first nose portion 301. As discussed above in conjunction with FIGS. 2A and 2B, the cementing plug 300 may be directed downhole through a casing 309 until it reaches a landing collar 310. When the cementing plug 300 reaches the landing collar 310, the fluid pressure increases inside the mandrel 305 such that a first set of springs 307 are compressed. The first nose portion 301 may then extend downhole from the mandrel 305. Then, the fluid pressure may increase inside the second nose portion 303 such that a second set of springs 318 are compressed. The second nose portion 303 may then extend downhole from the first nose portion 301. Accordingly, the two nose portions 301 and 303 may be telescopically extendable. Although two nose portions are depicted and discussed in conjunction with FIG. 3, any number of telescopically extendable nose portions may be used without departing from the scope of the present disclosure. For instance, in certain embodiments, the nose 306 may include three or four separate telescoping portions.

Figure 4:
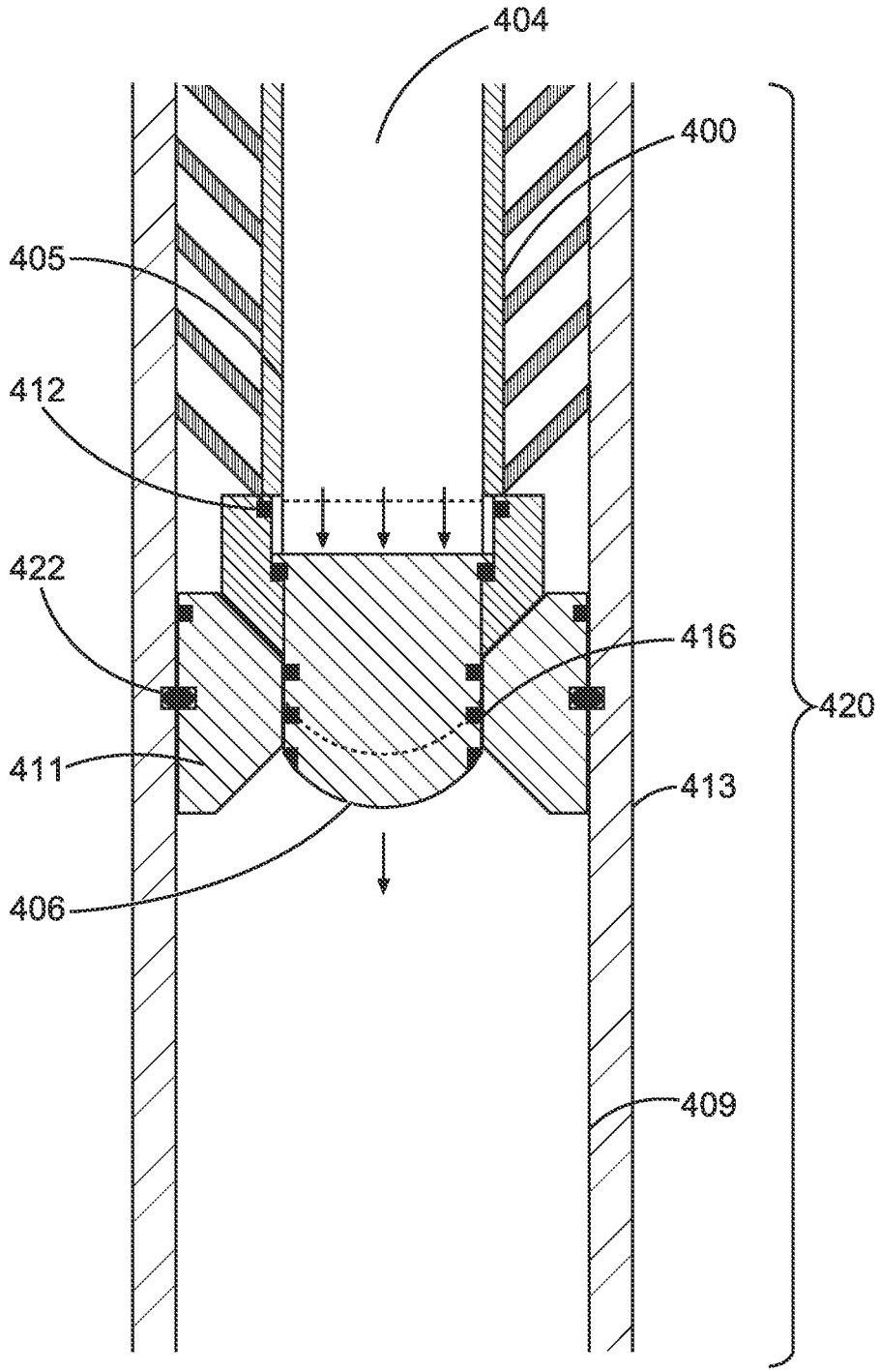
FIG. 4 shows the process of a plug activating a tool inside a wellbore in accordance with an embodiment of the present disclosure.

Referring now to FIG. 4, a cementing plug 400 may be used to activate a tool 420. The tool 420 may include multiple-stage cementers, annular casing packers, subsurface plug assemblies, kickoff assemblies, or any other plug or hydraulically operated cementing or completion tools. The tool 420 is coupled to a seat 411. The tool 420 remains dormant in the wellbore 413 until the cementing plug 400 shifts the seat 411, as described below, at which point the tool 420 may be operated. In the case of a multiple-stage cementers, the seat 411 is shifted to provide annular access so that a second-stage cement job can be pumped.

The cementing plug 400 having a nose 406 may be inserted into the casing 409. A displacement fluid 404 may be injected into the wellbore 413 through the casing 409 to help move the cementing plug 400 downhole. The cementing plug 400 continues to move downhole through the casing 409 until it lands on the seat 411. Then, pressure builds up behind the cementing plug 400 due to the displacement fluid 404 being pumped downhole. Shear pins 412 located within the cementing plug 400 are sheared, allowing the nose 406 of the cementing plug 400 to be extended. One or more sealing components 416 may be placed on the nose 406. With the nose 406 in the extended position, the sealing components 416 provide a seal between the seat 411 and the nose 406. When in the extended position, at least a portion of the nose 406 that was previously positioned within the mandrel 405 will be extended outside the mandrel 405. In certain implementations, there may be secondary shear pins 422 located on the seat 411. The secondary shear pins 422 operate to hold the seat 411 in place. When the nose 406 is extended, pressure builds up behind the extended nose 406 and is exerted on the seat 411. This pressure may cause the secondary shear pins 422 to shear, causing the seat 411 to slide, thus activating the tool 420. The nose 406 of the cementing plug 400 as depicted in FIG. 4 may include a first nose portion and a second nose portion (or more) as depicted in FIG. 3 and described above without departing from the scope of the present disclosure.

Figure 5A:
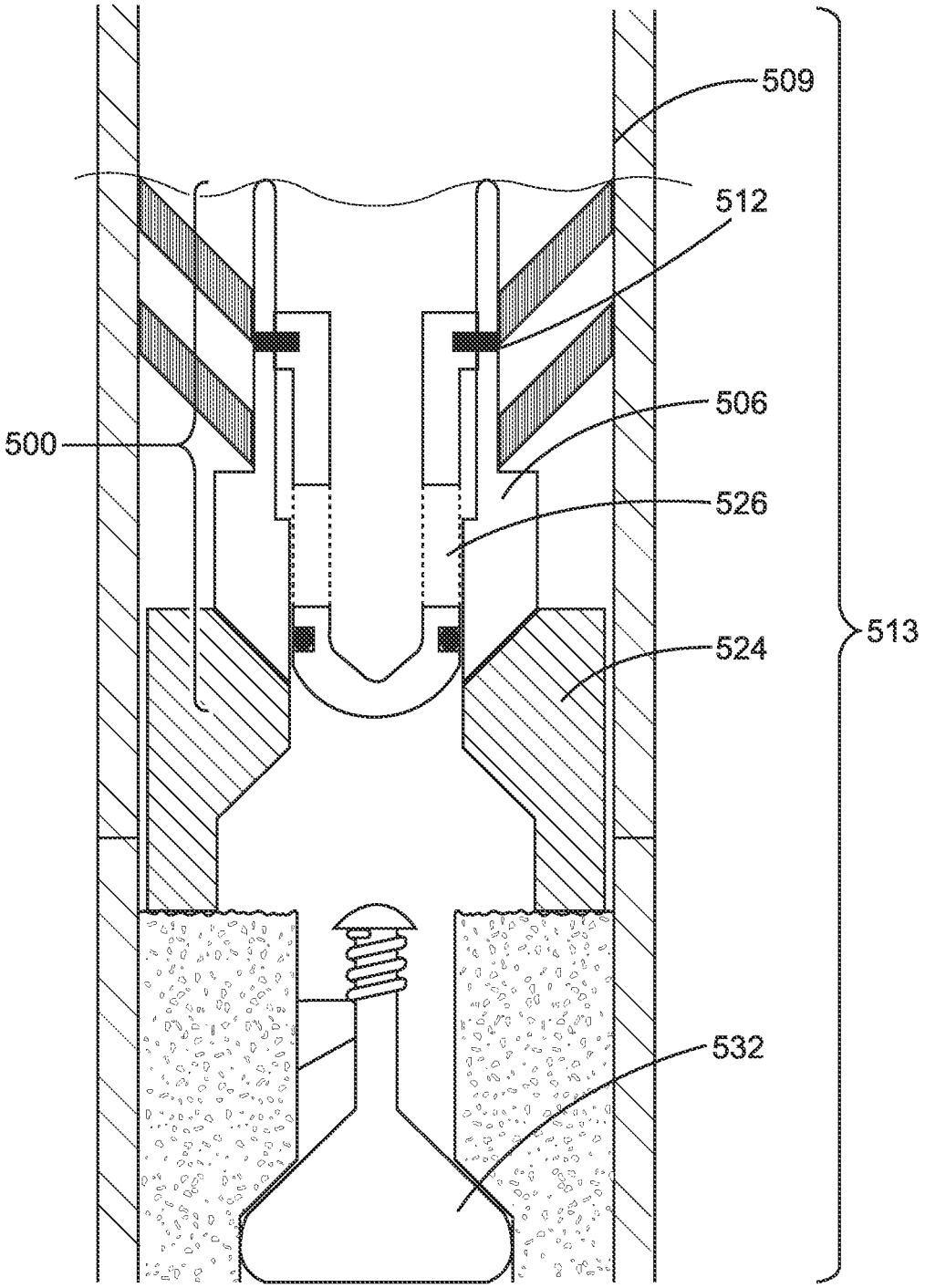
FIGS. 5A and 5B show a shutoff plug in a wellbore in accordance with an embodiment of the present disclosure.
Figure 5B:
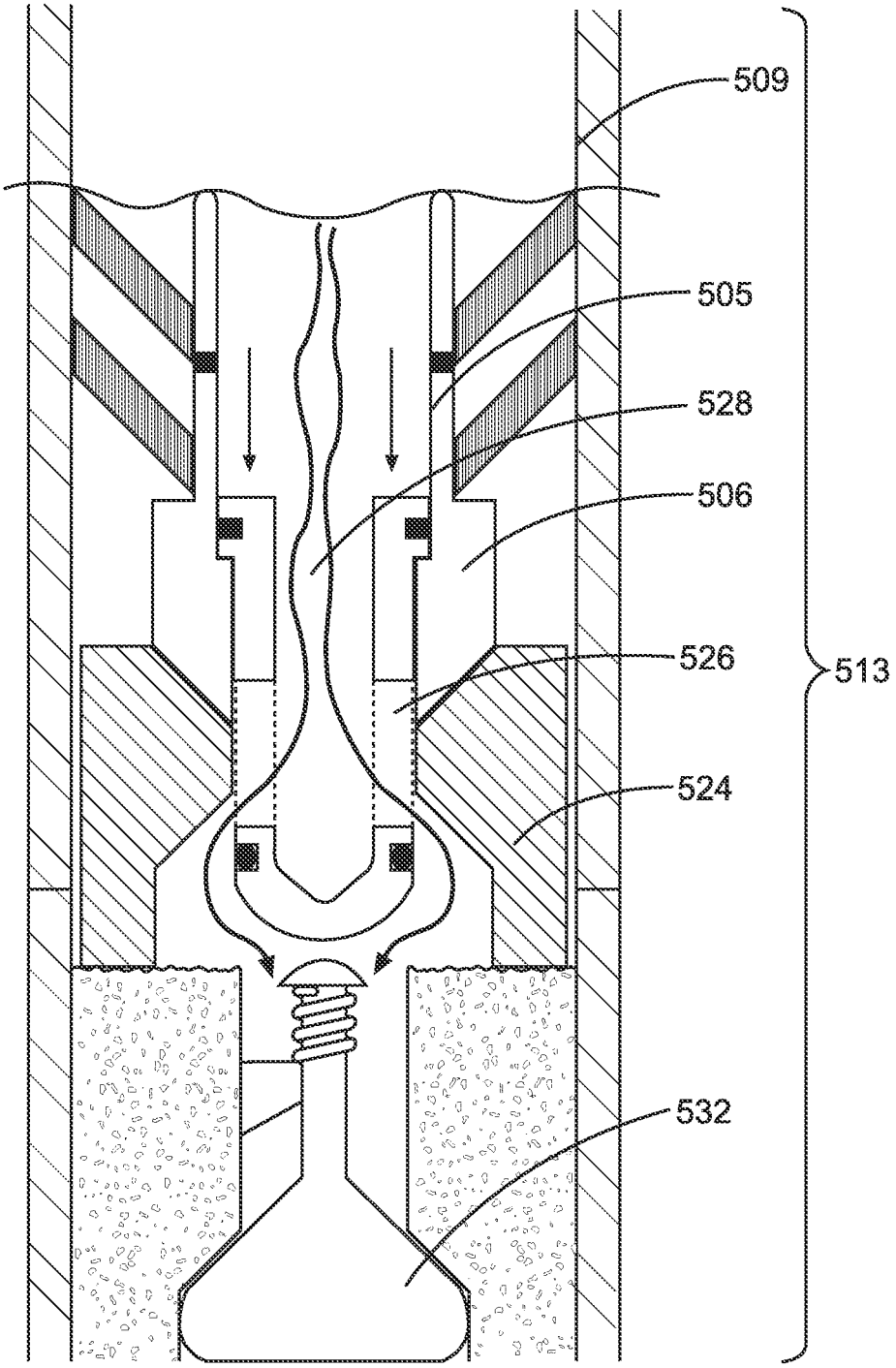

Referring now to FIG. 5A, a cementing plug 500 may be used to shut off the pumping of fluid in a wellbore 513. The cementing plug 500 may be used in conjunction with a multiple-stage cementer. The cementing plug 500 having a nose 506 may be inserted into the casing 509. The cementing plug 500 may displace a first stage of cement as it travels downhole. A fluid 528 may be injected into the wellbore 513 through the casing 509 to help move the cementing plug 500 downhole. A shutoff baffle 524 may be located within the wellbore 513. The cementing plug 500 continues to move downhole through the casing 509 until it lands on the shutoff baffle 524. This stops the pumping of fluid from the surface, as fluid will not bypass the cementing plug 500 while the nose 506 is in a retracted position, as shown in FIG. 5A. Pressure may then build up behind the nose 506. The pressure buildup may send a pressure spike confirmation to an operator at the surface of the wellbore 513 who may be monitoring wellbore pressure. The pressure may cause shear pins 512 located within the cementing plug 500 to be sheared, allowing the nose 506 of the cementing plug 500 to be extended. The shear pins 512 may be set to shear at a desired pressure at which it is desired for fluid flow to resume. Slots 526 may be located on the nose 506 of the cementing plug 500. As the nose 506 extends, the slots 526 allow fluid 528 to flow downhole, through the mandrel 505 and the nose 506, toward a float valve 532, as shown in FIG. 5B. Therefore, fluid 528 is allowed to bypass the cementing plug 500. This may be necessary to avoid hydraulic lock in the wellbore 513. The nose 506 of the cementing plug 500 as depicted in FIG. 5 may include a first nose portion and a second nose portion (or more) as depicted in FIG. 3 and described above without departing from the scope of the present disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified, and all such variations are considered within the scope and spirit of the present invention. Also, the terms in the claims have their plain, ordinary meaning unless otherwise explicitly and clearly defined by the patentee.

What is claimed is:

1. A system comprising, a cementing plug comprising a single unit configured to be released into and directed downward through a wellbore via a flow of fluid through the wellbore, wherein the cementing plug comprises:

a hollow mandrel;

one or more wiper elements coupled to the hollow mandrel;

a nose coupled to the hollow mandrel and movable between a retracted position and an extended position; and an energy storage mechanism disposed within the hollow mandrel and coupled to the nose, wherein the energy storage mechanism retains the nose at least partially inside the hollow mandrel when the nose is in the extended position, wherein a portion of the nose is positioned within the hollow mandrel when in the retracted position, wherein the portion of the nose is positioned outside the hollow mandrel when in the extended position, and wherein the nose is coupled to the hollow mandrel when the hollow mandrel is first disposed in the wellbore, and wherein the nose remains coupled to the hollow mandrel when the nose is in both the retracted position and the extended position.

2. The cementing plug of claim 1, wherein the nose may be set to extend at a desired well pressure.

3. The cementing plug of claim 1, wherein the nose engages a landing collar when in the extended position.

4. The cementing plug of claim 1, wherein the nose comprises:

a first nose, wherein the first nose is movable between a retracted position and an extended position relative to the hollow mandrel in direction of a longitudinal axis of the cementing plug; and a second nose, wherein the second nose is movable between a retracted position and an extended position relative to the first nose in the direction of the longitudinal axis of the cementing plug, wherein the second nose is positioned within the first nose when the second nose is in the retracted position, and wherein the second nose engages a landing collar when the second nose is in the extended position and the first nose is in the extended position.

5. The cementing plug of claim 1, wherein the cementing plug is operable to activate a tool.

6. The cementing plug of claim 1, wherein the nose engages a shutoff baffle when in the extended position.

7. The cementing plug of claim 1, wherein the cementing plug operates to shut off fluid flow in the wellbore when the nose is in the retracted position.

8. The cementing plug of claim 7, wherein the nose further comprises slots, and wherein the cementing plug operates to allow fluid flow in the wellbore when the nose is in the extended position.

* * * * *